US008754628B2

(12) United States Patent
Namai et al.

(10) Patent No.: US 8,754,628 B2
(45) Date of Patent: Jun. 17, 2014

(54) VOLTAGE REGULATOR FOR HIGH SPEED SWITCHING OF VOLTAGES

(75) Inventors: Atsushi Namai, Kanagawa-ken (JP); Kei Kasai, Tokyo (JP); Shigeyuki Sakura, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 322 days.

(21) Appl. No.: 13/234,780

(22) Filed: Sep. 16, 2011

(65) Prior Publication Data

US 2012/0229116 A1 Sep. 13, 2012

(30) Foreign Application Priority Data

Mar. 10, 2011 (JP) ..... 2011-052522

(51) Int. Cl.
*G05F 1/56* (2006.01)
*G05F 1/563* (2006.01)

(52) U.S. Cl.
USPC ..... 323/311; 323/275

(58) Field of Classification Search
USPC ..... 323/271–281
See application file for complete search history.

(56) References Cited

U.S. PATENT DOCUMENTS

| | | | | |
|---|---|---|---|---|
| 6,087,813 | A * | 7/2000 | Tobita | 323/280 |
| 7,154,253 | B1 * | 12/2006 | Gunther | 323/283 |
| 7,777,459 | B2 * | 8/2010 | Williams | 323/266 |
| 2010/0201331 | A1 | 8/2010 | Imura | |

FOREIGN PATENT DOCUMENTS

| | | | |
|---|---|---|---|
| CN | 101799697 | A | 8/2010 |
| JP | 2003-29855 | A | 1/2003 |
| JP | 2007-288974 | | 11/2007 |
| JP | 2010-55490 | A1 | 3/2010 |

OTHER PUBLICATIONS

Japanese Office Action issued on May 16, 2013 in the counterpart Japanese patent application No. 2011-052522, an English translation thereof.

CN Office Action received in corresponding CN Application No. 20111025217.0 dated Nov. 28, 2013, and an English translation thereof.

* cited by examiner

*Primary Examiner* — Adolf Berhane
*Assistant Examiner* — Nusrat Quddus
(74) *Attorney, Agent, or Firm* — White & Case LLP

(57) ABSTRACT

According to one embodiment, a voltage regulator includes an output transistor, a voltage detector, a controller, and a discharge circuit. The output transistor is connected between a power supply terminal and an output terminal. The voltage detector is connected between the output terminal and a ground terminal. The voltage detector is configured to divide an output voltage between the output terminal and the ground terminal according to an inputted voltage switching signal and generates a first voltage on the ground terminal side and a second voltage having a polarity the same as a polarity of the first voltage and having an absolute value lower than or equal to an absolute value of the first voltage. The controller is configured to detect a difference between the first voltage and a reference voltage and control the output transistor.

20 Claims, 6 Drawing Sheets

Vsel
0
t
4ms
2.9V

Vout
1.8V
0
t

Va
Vref
0
t

Vg
0
t1
t2
t

Vsel
0
t
4ms
2.9V

Vout
P
1.8V
0
t

Va
0
t

Vg
0
t1
t2
t3
t

VOLTAGE REGULATOR FOR HIGH SPEED SWITCHING OF VOLTAGES

CROSS-REFERENCE TO RELATED APPLICATIONS

This application is based upon and claims the benefit of priority from the prior Japanese Patent Application No. 2011-052522, filed on Mar. 10, 2011; the entire contents of which are incorporated herein by reference.

FIELD

Embodiments described herein relate generally to a voltage regulator.

BACKGROUND

With demands for a reduction in power consumption, the voltage of integrated circuits such as a CPU (Central Processing Unit) is reduced more and more. On the other hand, in some cases, a relatively high voltage is needed because of higher functionalities or compatibility with conventional systems. For example, in a power supply for driving a CPU, it is necessary to switch supply voltages because the CPU changes power consumption by switching states. In a power supply for driving an IC card mounted with a memory or the like, it is necessary to switch and supply a supply voltage in order to meet a plurality of specifications having different operating voltages. With an increase in the speed of devices, high speed switching is demanded for switching supply voltages. However, in the case of decreasing a supply voltage, the supply voltage does not reach a desired voltage until electric charges stored in a capacitance between an output terminal and a ground terminal are discharged, so an increase in the speed is restricted.

DETAILED DESCRIPTION

Figure 1:
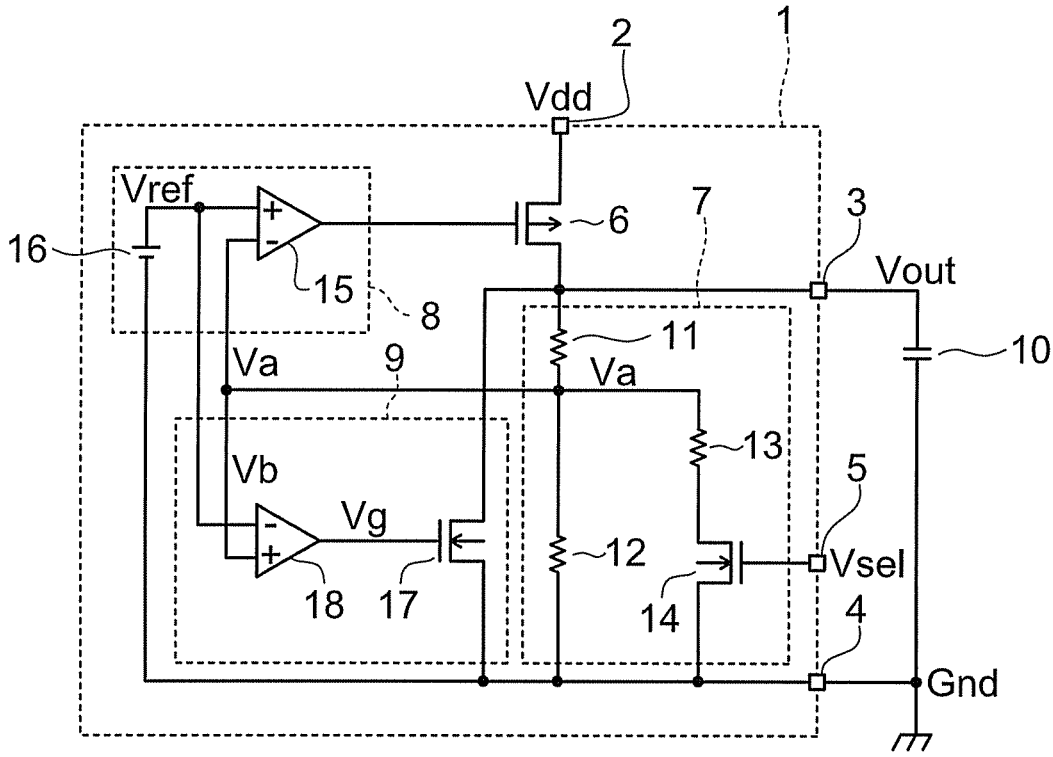
FIG. 1 is a circuit diagram illustrating a configuration of a voltage regulator according to a first embodiment.

In general, according to one embodiment, a voltage regulator includes an output transistor, a voltage detector, a controller, and a discharge circuit. The output transistor is connected between a power supply terminal and an output terminal. The voltage detector is connected between the output terminal and a ground terminal. The voltage detector is configured to divide an output voltage between the output terminal and the ground terminal according to an inputted voltage switching signal and generates a first voltage on the ground terminal side. In addition the voltage detector is configured to generate a second voltage having a polarity the same as a polarity of the first voltage and having an absolute value lower than or equal to an absolute value of the first voltage. The controller is configured to detect a difference between the first voltage and a reference voltage to be a reference of the output voltage generated at the output terminal and control the output transistor so as to reduce the difference. The discharge circuit is connected between the output terminal and the ground terminal. The discharge circuit is configured to discharge electric charges from the output terminal to the ground terminal when an absolute value of the second voltage is higher than an absolute value of the reference voltage.

Hereinafter, embodiments of the invention will now be described in detail with reference to the drawings. In the specification and drawings, components similar to those described or illustrated in a drawing thereinabove are marked with like reference numerals, and a detailed description is omitted as appropriate.

First Embodiment

FIG. 1 is a circuit diagram illustrating a configuration of a voltage regulator according to a first embodiment.

As illustrated in FIG. 1, in a voltage regulator 1, an output transistor 6 is connected between a power supply terminal 2 and an output terminal 3. The output transistor 6 generates an output voltage Vout between the output terminal 3 and a ground terminal 4 for a voltage having the same polarity as the polarity of a supply voltage Vdd supplied to the power supply terminal 2 and having the absolute value of the voltage reduced.

The output transistor 6 is formed of a P-channel MOSFET (referred to as a PMOS below). A load capacitor 10 is connected between the output terminal 3 and the ground terminal 4, which represents external circuits connected between the output terminal 3 and the ground terminal 4. A capacitance of the load capacitor 10 is equivalent to summation of capacitances of the external circuits.

A voltage detector 7 is connected between the output terminal 3 and the ground terminal 4. The voltage detector 7 divides the output voltage Vout at a ratio of k ($k \geq 0$) to 1 and generates a first voltage Va and a second voltage Vb on the ground terminal side. Here, the ratio of k changes according to a voltage switching signal Vsel. In the voltage detector 7 shown in FIG. 1, the second voltage Vb is equal to the first voltage Va.

In the voltage detector 7, a first resistor 11 and a second resistor 12 are connected in series between the output terminal 3 and the ground terminal 4. The voltage detector 7 has a first switch element 14 that is switched on or off according to the voltage switching signal Vsel.

The first switch element 14 is turned on when the voltage switching signal Vsel is at high level, while the first switch element 14 is turned off when the voltage switching signal Vsel is at low level. The third resistor 13 is connected to the second resistor 12 in parallel through the first switch element 14. In FIG. 1, the first switch element 14 is formed of an N-channel MOSFET (referred to as an NMOS below).

The first voltage Va is generated across the second resistor 12 and the third resistor 13 through the first switch element 14.

In the case where the voltage switching signal Vsel is at high level, the first voltage Va is a divided voltage of the output voltage Vout by the first resistor 11 and the resultant resistance of the second and third resistors 12 and 13. In the case where the voltage switching signal Vsel is at low level, the first voltage Va is a divided voltage of the output voltage Vout by the first resistor 11 and the second resistor 12. An explanation will be given that the parasitic resistance of the first switch element 14 is included in the third resistor 13. The same thing is applied to the other embodiments.

As described above, the voltage detector 7 divides the output voltage Vout of the output terminal 3 at the ratio k and generates the first voltage Va on the ground terminal side. Here, the ratio k equals R2/(R1+R2) or R2×R3/(R2×R3+R1×(R2+R3)) and changes according to the voltage switching signal Vsel. Here, R1, R2, and R3 denote the resistances of the first resistor 11, the second resistor 12, and the third resistor 13, respectively.

The first voltage Va is inputted to a controller 8. The controller 8 has an amplifier 15 and a reference voltage generator 16 that generates a reference voltage Vref. Here, the reference voltage Vref is a voltage that is the reference of the output voltage Vout generated at the output terminal 3. The controller 8 operates to decrease a difference between the first voltage Va and the reference voltage Vref. Namely, the controller 8 controls the output transistor 6 in such a way that the first voltage Va is made equal to the reference voltage Vref.

The output voltage Vout is expressed by Equation (1).

$$Vout=Vref/k \quad (1)$$

As described above, the ratio of k changes according to the voltage switching signal Vsel, so it is possible to switch the output voltage Vout according to the voltage switching signal Vsel. The ratio k when the voltage switching signal Vsel is at high level is less than the ratio k when the voltage switching signal Vsel is at low level. Consequently, the absolute value of the output voltage Vout when the voltage switching signal Vsel is at high level is higher than the absolute value of the output voltage Vout when the voltage switching signal Vsel is at low level.

The second voltage Vb which is equal to the first voltage Va is inputted to a discharge circuit 9.

In the discharge circuit 9, a discharge transistor 17 is connected between the output terminal 3 and the ground terminal 4. A comparator 18 compares the second voltage Vb with the reference voltage Vref, and controls the discharge transistor 17.

The discharge transistor 17 is formed of an NMOS. The drain of the discharge transistor 17 is connected to the output terminal 3, and the source thereof is connected to the ground terminal 4. The gate of the discharge transistor 17 is connected to the output of the comparator 18. The second voltage Vb is inputted to the non-inverting input terminal of the comparator 18, and the reference voltage Vref is inputted to the inverting terminal thereof.

The comparator 18 outputs a high-level voltage when the absolute value of the second voltage Vb is higher than the absolute value of the reference voltage Vref, while outputs a low-level voltage when the absolute value of the second voltage Vb is lower than the absolute value of the reference voltage Vref.

The discharge circuit 9 discharges electric charges from the output terminal 3 to the ground terminal 4 when the absolute value of the second voltage Vb is higher than the absolute value of the reference voltage Vref.

As explained in FIG. 2, the discharge circuit 9 discharges electric charges from the output terminal 3 to the ground terminal 4, so it is possible to switch voltages at high speed.

In FIG. 1, the output transistor 6 is formed of a PMOS, and the first switch element 14 and the discharge transistor 17 are formed of an NMOS. However, it is also possible to form the output transistor 6 using an NMOS, and it is also possible to form the first switch element 14 and the discharge transistor 17 using a PMOS. It is also possible to form the output transistor 6, the first switch element 14, and the discharge transistor 17 using a bipolar transistor.

In the voltage detector 7, the third resistor 13 is connected to the second resistor 12 in parallel through the first switch element 14. However, if only the first voltage Va and the ratio k change according to the voltage switching signal Vsel, and other configurations are also possible.

Figures 2A, 2B, 2C, 2D:
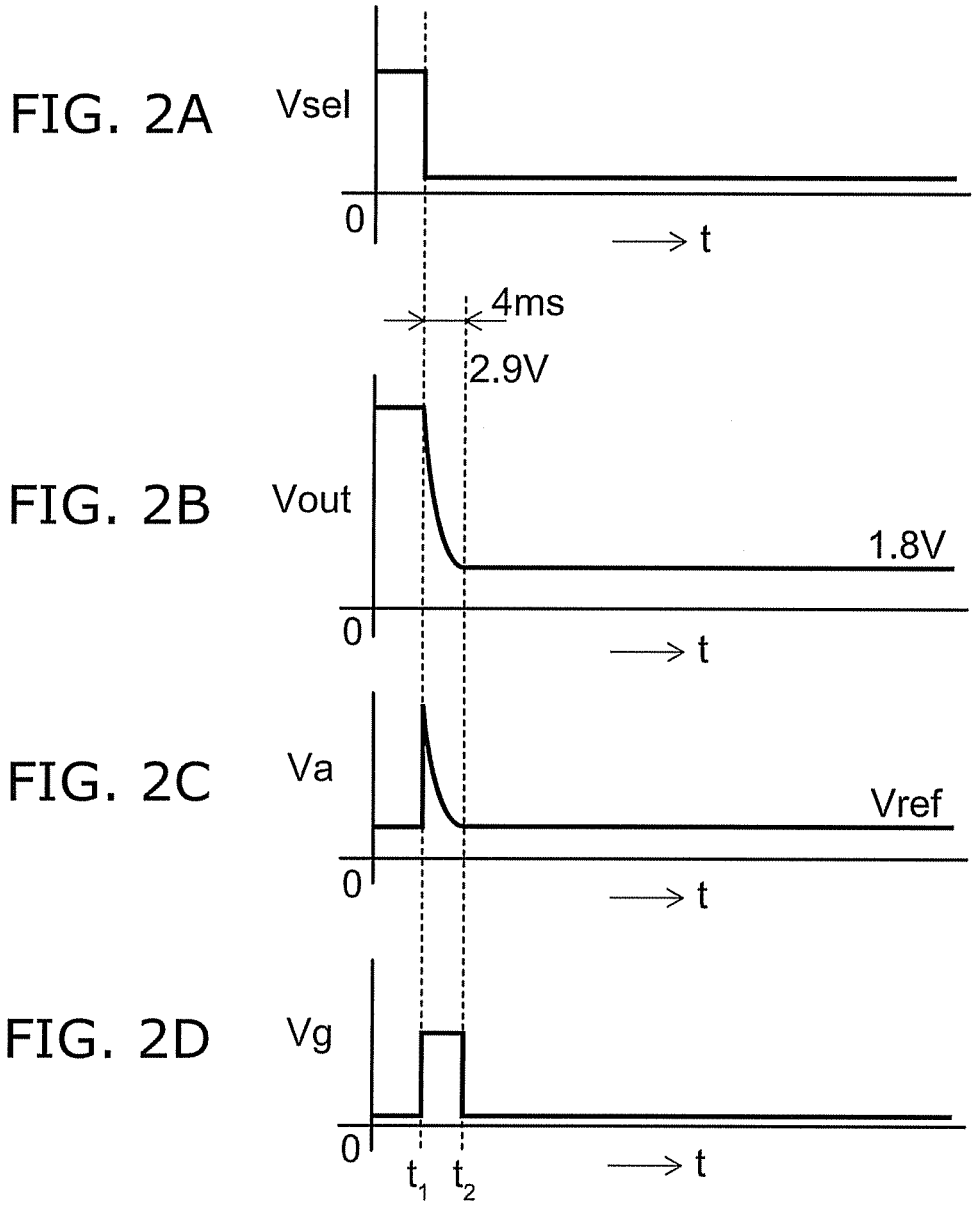
FIGS. 2A to 2D are waveform diagrams of main signals of the voltage regulator shown in FIG. 1.

FIGS. 2A to 2D are waveform diagrams of main signals of the voltage regulator shown in FIG. 1. FIG. 2A shows the voltage switching signal Vsel, FIG. 2B shows the output voltage Vout, FIG. 2C shows the first voltage Va, and FIG. 2D shows a gate voltage Vg of the discharge transistor.

In FIGS. 2A to 2D, time t is plotted on the horizontal axis to show the waveform diagrams of the signal and the voltages. The case is illustrated as an example where the output voltage Vout is switched from a high voltage of 2.9 V to a low voltage of 1.8 V. The second voltage Vb is omitted in the drawing because the second voltage Vb is equal to the first voltage Va. The term "absolute value" is appropriately omitted from the voltages because the voltages have a positive polarity.

When the voltage switching signal Vsel is at high level (FIG. 2A), the output voltage Vout is at a high voltage of 2.9 V (FIG. 2B). In a steady state ($t<t_1$), the first voltage Va is equal to the reference voltage Vref (FIG. 2C), the gate voltage Vg of the discharge transistor 17 is at low level. Consequently, the discharge transistor 17 is off, and the discharge transistor 17 does not affect the operations of the output transistor 6 and the voltage detector 7. The ratio k that divides the output voltage Vout and generates the first voltage Va in the voltage detector 7 is R2×R3/(R2×R3+R1×(R2+R3)).

At time $t=t_1$, the voltage switching signal Vsel is changed from high level to low level to switch the output voltage Vout (FIG. 2A). The ratio k at which the output voltage Vout is divided and the first voltage Va generated in the voltage detector 7 is reduced from R2×R3/(R2×R3+R1×(R2+R3)) to R2/(R1+R2). However, the output voltage Vout decreases slowly because of electric charges stored in the load capacitor 10. Thus, the first voltage Va is instantaneously increased to Vout×R2/(R1+R2) (about 2.26 V in FIG. 2C). The first voltage Va and the second voltage Vb are made higher than the reference voltage Vref.

Since the second voltage Vb is higher than the reference voltage Vref, the comparator 18 outputs a high-level voltage for the gate voltage Vg of the discharge transistor 17 (FIG. 2D). The discharge transistor 17 is turned on, and discharges electric charges stored in the load capacitor 10 connected between the output terminal 3 and the ground terminal 4 to the ground terminal 4.

Consequently, the output voltage Vout is quickly reduced in accordance with a time constant determined by the ON resistance of the discharge transistor 17 and the capacitance of the load capacitor 10 (FIG. 2B). With a reduction in the output voltage Vout, the first voltage Va is quickly reduced to the reference voltage Vref (FIG. 2C).

When the second voltage Vb is equal to the first voltage Va and the second voltage Vb is equal to the reference voltage Vref at time $t=t_2$, the comparator 18 outputs a low-level voltage for the gate voltage Vg (FIG. 2D). The discharge transistor 17 is turned off, and the discharge of electric charges stored in the load capacitor 10 to the ground terminal 4 is blocked.

In this state, the first voltage Va is equal to the reference voltage Vref (FIG. 2C), and the output voltage Vout is a desired low voltage of 1.8 V.

After that, the controller 8 controls the first voltage Va to be equal to the reference voltage Vref to stabilize the output voltage Vout at a constant value (FIG. 2B).

When the voltage switching signal Vsel is changed to reduce the output voltage Vout as described above, the output voltage Vout is quickly reduced in accordance with a time constant determined by the ON resistance of the discharge transistor 17 and the capacitance of the load capacitor 10. Here, the resultant resistance of the resistors R11 and R12 is assumed to be negligible to the ON resistance of the discharge transistor 17.

Here, the case is considered as a comparative example where the discharge circuit 9 is not provided. In the case of the comparative example, the output voltage Vout is reduced in accordance with a time constant determined by the resultant resistance of the first resistor 11 and the second resistor 12 in the voltage detector 7 and the capacitance of the load capacitor 10. Thus, it takes a long time to reduce the output voltage Vout to a desired low voltage of 1.8 V.

The voltage switching time necessary to reduce the output voltage Vout from V1 (at $t=t_1$) to V2 (at $t=t_2$) is expressed as Equation (2).

$$T=C\times(R1+R2)\times\ln(V1/V2) \quad (2)$$

For example, in the case where the capacitance of the load capacitor 10 is 2.8 μF and the resultant resistance of the resisters R1 and R2 of the first resistor 11 and the second resistor 12 is 350 kΩ the voltage switching time determined by the time constant is 0.47 s according to Equation (2).

On the contrary, in the voltage regulator 1, the time constant is determined by the capacitance of the load capacitor 10 and a resultant resistance of an ON resistance Ron of the discharge transistor 17 and the series resistance of the first resistor 11 and the second resistor 12 of the discharge circuit 9. For example, suppose that the ON resistance Ron of the discharge transistor 17 is 3 kΩ, the voltage switching time is reduced to 4 ms according to Equation (2).

The voltage switching time can be changed according to the value of the ON resistance Ron of the discharge transistor 17 and the value of the second voltage Vb inputted to the comparator 18. In order to shorten the voltage switching time, it is preferable that the ON resistance Ron of the discharge transistor 17 be smaller. However, the lower limit of the ON resistance Ron of the discharge transistor 17 is restricted in consideration of a discharge current.

As described above, in the voltage regulator 1, the discharge duration of the discharge circuit 9 is regulated as the time that the absolute value of the second voltage Vb is higher than the absolute value of the reference voltage Vref. Consequently, when the absolute value of the output voltage Vout is reduced to the absolute value of a desired low voltage, discharge is immediately stopped. Thus, for example, as compared with the case where the discharge circuit 9 is operated in synchronization with a certain clock or the discharge circuit 9 is operated for a preset delay time, the switching time is shortened, and an increase in power consumption due to a discharge current is suppressed.

In the discharge circuit 9, when the absolute value of the second voltage Vb is made lower than the absolute value of the reference voltage Vref, the comparator 18 outputs a low-level voltage for the gate voltage Vg of the discharge transistor 17. Thus, the discharge transistor 17 is turned off, and the impedance of the discharge transistor 17 between the output terminal 3 and the ground terminal 4 is made in a high impedance state. Consequently, in a steady state ($t>t_2$), the discharge transistor 17 does not affect the operations of the voltage detector 7 and the controller 8.

When the absolute value of the second voltage Vb is made higher than the absolute value of the reference voltage Vref, it is likely that the comparator 18 outputs a high-level voltage due to noise in a steady state in which the voltage switching signal Vsel is constant. However, the discharge transistor 17 is not wrongly turned on if a hysteresis is provided for the response characteristics of the input voltage and output voltage of the comparator 18.

Second Embodiment

Figure 3:
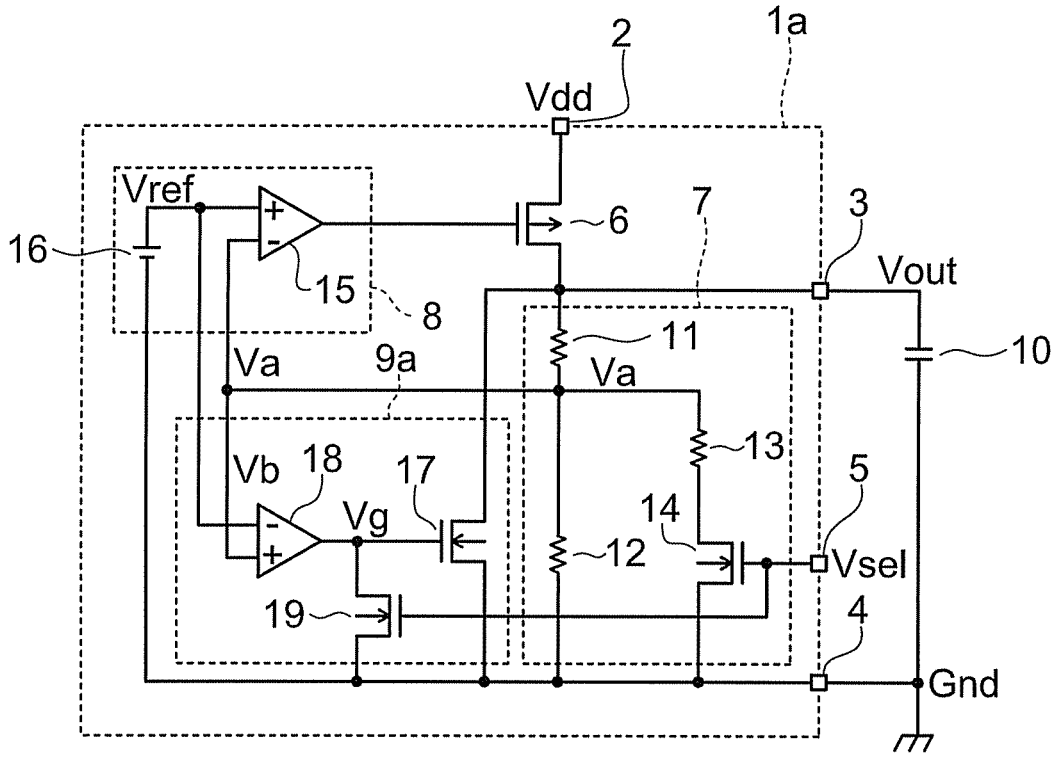
FIG. 3 is a circuit diagram illustrating a configuration of a voltage regulator according to a second embodiment.

FIG. 3 is a circuit diagram illustrating a configuration of a voltage regulator according to a second embodiment.

As illustrated in FIG. 3, a voltage regulator 1*a* is configured in which the discharge circuit 9 of the voltage regulator 1 shown in FIG. 1 is replaced by a discharge circuit 9*a*. Points other than this point are the same as those in the voltage regulator 1. In FIG. 3, components similar to those in FIG. 1 are marked with like reference numerals.

In the discharge circuit 9*a*, a blocking transistor 19 is additionally provided in the discharge circuit 9. The blocking transistor 19 is formed of an NMOS, and connected between the gate of a discharge transistor 17 and a ground terminal 4. The gate of the blocking transistor 19 receives a voltage switching signal Vsel.

The blocking transistor 19 is turned on or off according to the voltage switching signal Vsel.

When the voltage switching signal Vsel is at high level, the blocking transistor 19 is turned on to stop discharge by keeping the discharge transistor 17 OFF state. Namely, the blocking transistor 19 stops discharge when the ratio k of a voltage detector 7 is relatively small. Consequently, the discharge transistor 17 is not wrongly turned on to discharge electric charges in a steady state in which the voltage switching signal Vsel is at high level.

Figures 4A, 4B, 4C, 4D:
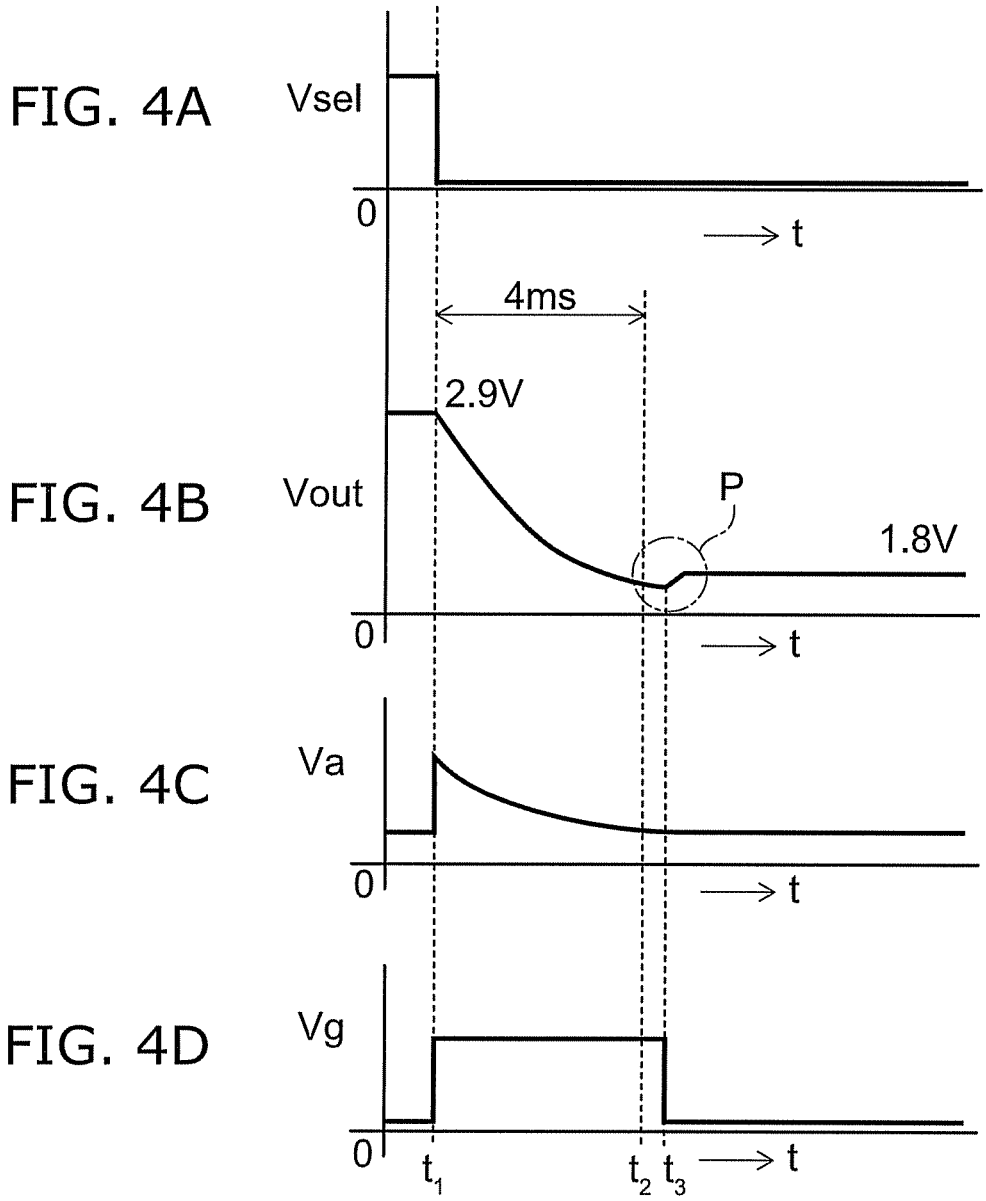
FIGS. 4A to 4D are waveform diagrams of main signals of the voltage regulator shown in FIG. 3.

FIGS. 4A to 4D are waveform diagrams of main signals of the voltage regulator shown in FIG. 3. FIG. 4A shows the voltage switching signal Vsel, FIG. 4B shows an output voltage Vout, FIG. 4C shows a first voltage Va, and FIG. 4D shows a gate voltage Vg of the discharge transistor.

In FIGS. 4A to 4D, time t is plotted on the horizontal axis to show the waveform diagrams of the signal and the voltages. The case is illustrated as an example where the output voltage Vout is switched from a high voltage of 2.9 V to a low voltage of 1.8 V. The term "absolute value" is appropriately omitted from the voltages because the voltages have a positive polarity.

Similarly to FIG. 2, a second voltage Vb is omitted in the drawing because the second voltage Vb is equal to the first voltage Va. In FIGS. 4A to 4D, the input offset voltage of a comparator 18 is considered. Namely, it is the case where there is a positive input offset voltage from a non-inverting input terminal to an inverting input terminal.

When the voltage switching signal Vsel is at high level (FIG. 4A), the output voltage Vout is at a high voltage of 2.9 V (FIG. 4B). In a steady state ($t<t_1$), the first voltage Va is equal to the reference voltage Vref (FIG. 4C). Since the second voltage Vb is equal to the reference voltage Vref, the gate voltage Vg of the discharge transistor 17 is at low level.

Since the voltage switching signal Vsel is at high level, the blocking transistor 19 is on, so the gate voltage Vg of the discharge transistor 17 is maintained at low level even though the output voltage Vout or the second voltage Vb fluctuates due to noise or the like (FIG. 4D). Consequently, the discharge transistor 17 is off, and the discharge transistor 17 does not affect the operations of an output transistor 6 and the voltage detector 7.

At time $t=t_1$, the voltage switching signal Vsel is changed from high level to low level to switch the output voltage Vout. (FIG. 4A). The blocking transistor 19 is turned off.

The ratio k at which the output voltage Vout is divided and the first voltage Va is generated on the ground terminal side in the voltage detector 7 is reduced from R2×R3/(R2×R3+R1×(R2+R3)) to R2/(R1+R2). However, the output voltage Vout (2.9 V) is reduced slowly because of electric charges stored in a load capacitor 10. Thus, the first voltage Va is instantaneously increased to Vout×R2/(R1+R2) (about 2.26 V in FIG. 4C). The first voltage Va and the second voltage Vb are made higher than the reference voltage Vref.

Since the second voltage Vb is higher than the reference voltage Vref, the comparator 18 outputs a high-level voltage for the gate voltage Vg of the discharge transistor 17 (FIG. 4D). The discharge transistor 17 is turned on, and discharges electric charges stored in the load capacitor 10 connected between the output terminal 3 and the ground terminal 4 to the ground terminal 4.

Consequently, the output voltage Vout is quickly reduced in accordance with a time constant determined by the ON resistance of the discharge transistor 17 and the capacitance of the load capacitor 10 (FIG. 4B). Here, the resultant resistance of the first resistor R11 and the second resistor R12 is assumed to be negligible to the ON resistance of the discharge transistor 17. With a reduction in the output voltage Vout, the first voltage Va is quickly reduced to a voltage that an input offset voltage is subtracted from the reference voltage Vref (FIG. 4C).

The output voltage Vout is made to be a desired low voltage of 1.8 V at time $t=t_2$. However, the comparator 18 keeps outputting a high-level voltage for the gate voltage Vg due to the input offset voltage (FIG. 4D).

When the second voltage Vb is made lower than the reference voltage Vref by the input offset at time $t=t_3$, the comparator 18 outputs a low-level voltage for the gate voltage Vg (FIG. 4D). The discharge transistor 17 is turned off, and the discharge of electric charges stored in the load capacitor 10 to the ground terminal 4 is blocked.

In this state, since the first voltage Va is lower than the reference voltage Vref by the input offset voltage, an undershoot occurs in the output voltage Vout (a portion surrounded by a chain line P in FIG. 4B). The output voltage Vout is then made a desired low voltage of 1.8 V.

After that, a controller 8 controls the first voltage Va to be equal to the reference voltage Vref to stabilize the output voltage Vout at a constant value (FIG. 4B).

When the voltage switching signal Vsel is changed to reduce the output voltage Vout as described above, the output voltage Vout is quickly reduced in accordance with a time constant determined by the ON resistance of the discharge transistor 17 and the capacitance of the load capacitor 10. In a steady state ($t<t_1$) in which the voltage switching signal Vsel is at high level where the ratio k is relatively small, the discharge transistor 17 is not wrongly turn on because the blocking transistor 19 is turned on.

In the voltage regulator 1*a*, the time constant is determined by an ON resistance Ron of the discharge transistor 17 of the discharge circuit 9 and the capacitance of the load capacitor 10. For example, suppose that the ON resistance Ron of the discharge transistor 17 is at 3 kΩ and the capacitance of the load capacitor 10 is 2.8 uF, the voltage switching time is reduced to 4 ms.

Here, the case is explained as the comparator 18 has an input offset voltage, it is likely that an undershoot similarly occurs in the case where an amplifier 15 has an input offset voltage.

Next, an embodiment in which the aforementioned problem of the undershoot is solved will be described.

Third Embodiment

Figure 5:
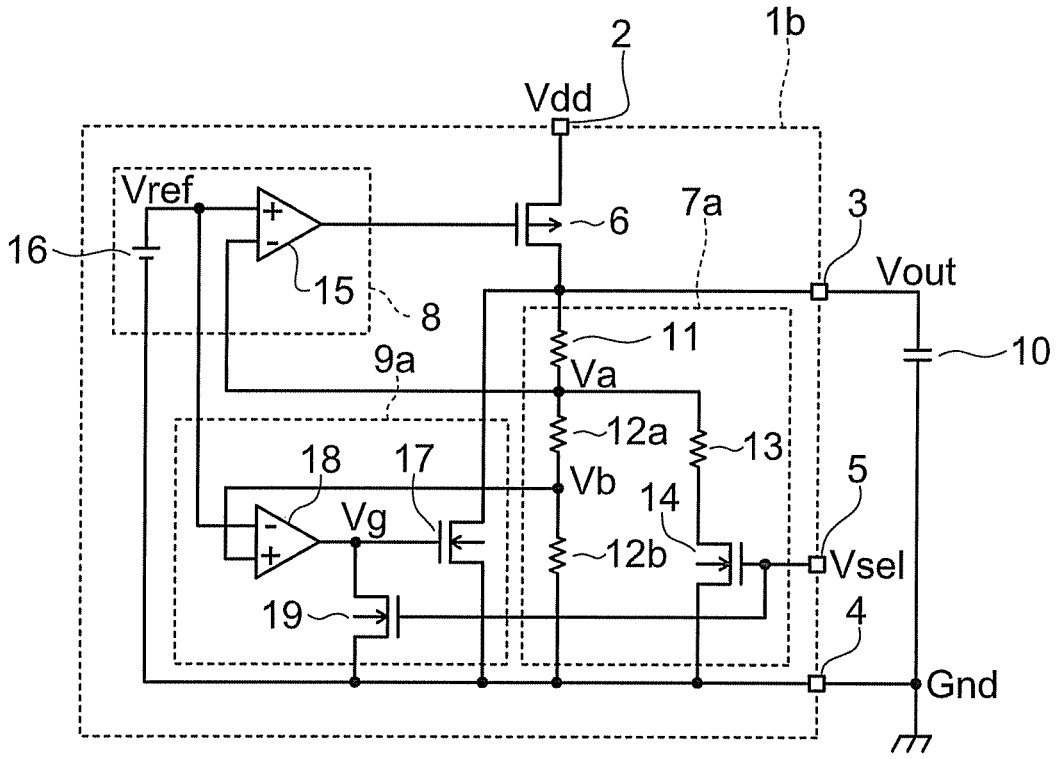
FIG. 5 is a circuit diagram illustrating a configuration of a voltage regulator according to a third embodiment.

FIG. 5 is a circuit diagram illustrating a configuration of a voltage regulator according to a third embodiment.

As illustrated in FIG. 5, a voltage regulator 1*b* is configured in which the voltage detector 7 of the voltage regulator 1*a* shown in FIG. 3 is replaced by a voltage detector 7*a*. Points other than this point are the same as those in the voltage regulator 1*a*. In FIG. 5, components similar to those in FIG. 3 are marked with like reference numerals.

In the voltage detector 7*a*, the second resistor 12 of the voltage detector 7 is replaced by second resistors 12*a* and 12*b*. The second resistor 12*a* and the second resistor 12*b* are connected in series.

A first voltage Va is generated at a connection point between a first resistor 11 and the second resistor 12*a*, and a second voltage Vb is generated at a connection point between the second resistor 12*a* and the second resistor 12*b*.

Suppose that the resistances of the second resistor 12*a* and the second resistor 12*b* are set to R2*a* and R2*b*, respectively. The first voltage Va is the same as the first voltage Va in the voltage regulators 1 and 1*a*, where R2=R2*a*+R2*b*.

The absolute value of the second voltage Vb is lower than the absolute value of the first voltage Va by a voltage drop across the second resistor 12*a*. The absolute value of the second voltage Vb is set to be lower than a voltage that an input offset voltage is subtracted from the absolute value of the first voltage Va. Here, the input offset voltage is a sum of an input offset voltage of an amplifier 15 and an input offset voltage of a comparator 18.

Figures 6A, 6B, 6C, 6D:
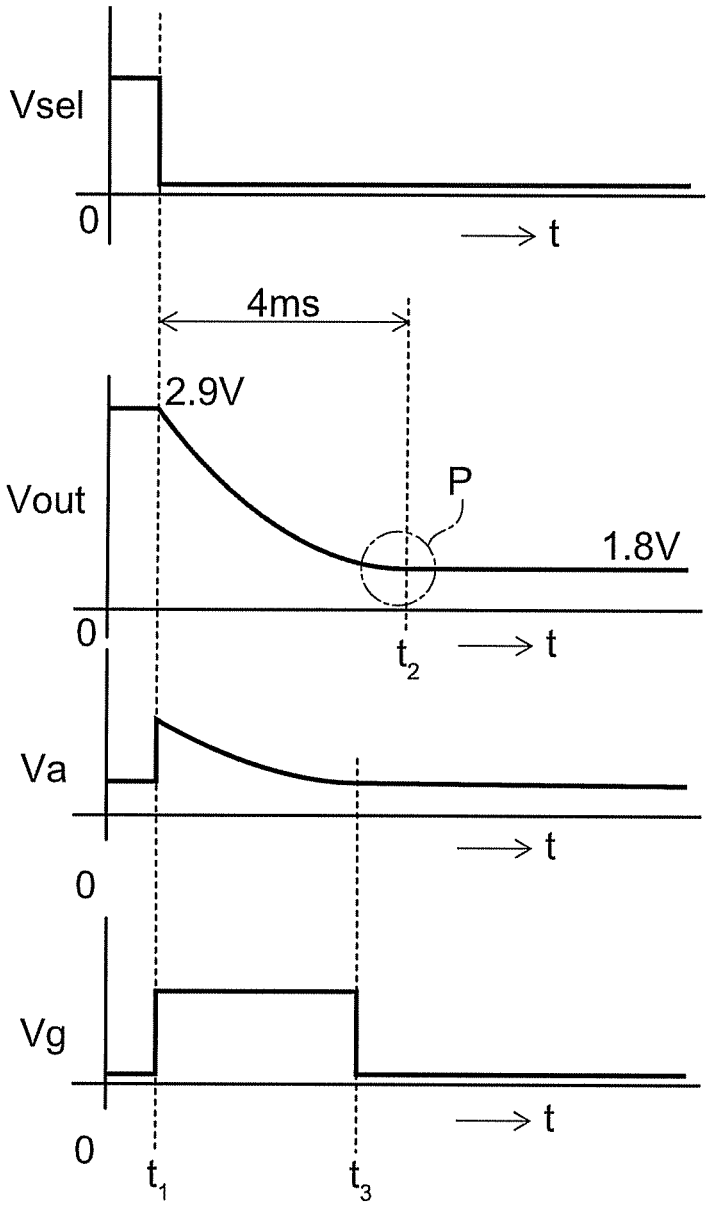
FIGS. 6A to 6D are waveform diagrams of main signals of the voltage regulator shown in FIG. 5.

FIGS. 6A to 6D are waveform diagrams of main signals of the voltage regulator shown in FIG. 5. FIG. 6A shows a voltage switching signal Vsel, FIG. 6B shows an output voltage Vout, FIG. 6C shows the first voltage Va, and FIG. 6D shows a gate voltage Vg of a discharge transistor.

In FIGS. 6A to 6D, time t is plotted on the horizontal axis to show the waveform diagrams of the signal and the voltages. The case is illustrated as an example where the output voltage Vout is switched from a high voltage of 2.9 V to a low voltage of 1.8 V. Although omitted in the drawing, the absolute value of the second voltage Vb is lower than the absolute value of the first voltage Va by a voltage drop across the second resistor 12*a*. The term "absolute value" is appropriately omitted from the voltages because the voltages have a positive polarity.

When the voltage switching signal Vsel is at high level (FIG. 6A), the output voltage Vout is at a high voltage of 2.9 V (FIG. 6B). In a steady state ($t<t_1$), the first voltage Va is equal to a reference voltage Vref if the input offset voltage of the amplifier 15 is ignored (FIG. 6C). Since the second voltage Vb is lower than the reference voltage Vref even in consideration of the input offset of the comparator 18, the gate voltage Vg of a discharge transistor 17 is at low level.

Since the voltage switching signal Vsel is at high level, a blocking transistor 19 is on, so the gate voltage Vg of the discharge transistor 17 is maintained at low level even though the output voltage Vout or the second voltage Vb fluctuates due to noise or the like (FIG. 6D). Consequently, the discharge transistor 17 is off, and the discharge transistor 17 does not affect the operations of the output transistor 6 and the voltage detector 7*a*.

At time $t=t_1$, the voltage switching signal Vsel is changed from high level to low level to switch the output voltage Vout (FIG. 6A), the blocking transistor 19 is turned off.

The ratio k at which the output voltage Vout is divided and the first voltage Va is generated on the ground terminal side in the voltage detector 7*a* is reduced from R2×R3/(R2×R3+R1×(R2+R3)) to R2/(R1+R2). However, the output voltage Vout (2.9 V) is reduced slowly because of electric charges stored in a load capacitor 10. Thus, the first voltage Va is instantaneously increased to Vout×R2/(R1+R2) (about 2.26 V in FIG. 4C), where R2=R2*a*+R2*b*. The first voltage Va and the second voltage Vb are made higher than the reference voltage Vref.

Since the second voltage Vb is higher than the reference voltage Vref, the comparator 18 outputs a high-level voltage for the gate voltage Vg of the discharge transistor 17 (FIG. 6D). The discharge transistor 17 is turned on, and discharges electric charges stored in the load capacitor 10 connected between an output terminal 3 and a ground terminal 4 to the ground terminal 4.

Consequently, the output voltage Vout is quickly reduced in accordance with a time constant determined by the ON resistance of the discharge transistor 17 and the capacitance of the load capacitor 10 (FIG. 6B). Here, the resultant resistance of the first resistor R11 and second resistors R12*a* and R12*b* is assumed to be negligible to the ON resistance of the discharge transistor 17. With a reduction in the output voltage Vout, the first voltage Va is quickly reduced to the reference voltage Vref (FIG. 6C).

When the second voltage Vb is made lower than a voltage that an input offset voltage is subtracted from the reference voltage Vref at time $t=t_3$, the comparator 18 outputs a low-level voltage for the gate voltage Vg (FIG. 6D). The discharge transistor 17 is turned off, and the discharge of electric charges stored in the load capacitor 10 to the ground terminal 4 is blocked.

In this state, the first voltage Va is higher than the second voltage Vb by a voltage drop across the second resistor 12*a*, and the output voltage Vout is not yet made at a desired low voltage of 1.8 V (a portion surrounded by a chain line P in FIG. 6B). Consequently, an undershoot does not occur. While $t_3<t<t_2$, the output voltage Vout lowers in accordance with a time constant determined by the load capacitance of the load capacitor 10 and the resultant resistance of the first resistor R11 and the second resistors R12*a* and R12*b*. Then the output voltage Vout is made at a desired low voltage of 1.8 V.

After that, a controller 8 controls the first voltage Va to be equal to the reference voltage Vref to stabilize the output voltage Vout at a constant value (FIG. 6B).

The second voltage Vb is sufficiently lower than the reference voltage Vref when the output voltage Vout is made at a desired low voltage of 1.8 V, so that the comparator 18 does not output a high-level voltage for the gate voltage Vg due to noise or the like. The discharge transistor 17 is not wrongly turned on.

When the voltage switching signal Vsel is changed to reduce the absolute value of the output voltage Vout as described above, the absolute value of the output voltage Vout is quickly reduced in accordance with a time constant determined by the ON resistance of the discharge transistor 17 and the capacitance of the load capacitor 10. In a steady state in which the voltage switching signal Vsel is at high level where the ratio k is relatively small, the discharge transistor 17 is not wrongly turn on because the blocking transistor 19 is turned on. In a steady state in which the voltage switching signal Vsel is at low level where the ratio k is relatively large, the discharge transistor 17 is not wrongly turn on because the absolute value of the second voltage Vb of the comparator 18 is sufficiently lower than the absolute value of the reference voltage Vref. An undershoot does not occur when the absolute value of the output voltage Vout is lower than the desired low voltage.

The configurations of the voltage regulators 1, 1*a*, and 1*b* are described in the case where the supply voltage Vdd has a positive polarity. However, it is also possible to configure a voltage regulator supplied a negative voltage.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A voltage regulator comprising:

an output transistor connected between a power supply and an output connected to a capacitor;

a voltage detector connected between the output and a ground, the voltage detector being configured to divide an output voltage into a first voltage and a second voltage according to a switching signal, the output voltage being a voltage between the output and the ground, the second voltage having a polarity the same as a polarity of the first voltage and having an absolute value lower than or equal to an absolute value of the first voltage;

a controller configured to detect a difference between the first voltage and a reference voltage to be a reference of the output voltage generated at the output and control the output transistor so as to reduce the difference; and a discharge circuit connected between the output and the ground, the discharge circuit configured to discharge electric charges of the capacitor from the output to the ground when the absolute value of the second voltage after a change of the switching signal is higher than an absolute value of the reference voltage.

2. The regulator according to claim 1, wherein at least a ratio k ($0<k\leq1$) dividing the output voltage changes between a relatively large ratio and a relatively small ratio according to the switching signal, and the discharge circuit stops discharge when the ratio changing according to the switching signal is relatively small.

3. The regulator according to claim 1, wherein the absolute value of the second voltage is lower than the absolute value of the first voltage.

4. The regulator according to claim 1, wherein the controller has an amplifier configured to reduce the absolute value of the difference between the reference voltage and the first voltage, and the absolute value of the second voltage is lower than a value that an input offset voltage of the amplifier is subtracted from the absolute value of the first voltage.

5. The regulator according to claim 1, wherein the discharge circuit has a comparator configured to compare the reference voltage with the first voltage, and the absolute value of the second voltage is lower than a value that an input offset of the comparator is subtracted from the absolute value of the first voltage.

6. The regulator according to claim 1, wherein the second voltage is a voltage that the first voltage is divided.

7. The regulator according to claim 1, wherein the discharge circuit has a discharge transistor configured to be turned off when the absolute value of the second voltage is lower than the absolute value of the reference voltage and to be turned on when the absolute value of the second voltage is higher than the absolute value of the reference voltage, the discharge transistor being connected between the output and the ground.

8. The regulator according to claim 1, wherein the discharge circuit further has a blocking transistor configured to be turned on or off according to the switching signal, the blocking transistor being connected between a control terminal of the discharge transistor and the ground.

9. The regulator according to claim 1, wherein the voltage detector has a first switch element configured to be turned on or off according to the switching signal.

10. The regulator according to claim 1, wherein the voltage detector has:

a first resistor and a second resistor connected in series between the output and the ground; and a third resistor connected in parallel with the first resistor or the second resistor through a first switch element configured to be turned on or off according to the switching signal.

11. The regulator according to claim 1, wherein the capacitor is connected between the output and the ground.

12. The regulator according to claim 11, wherein at least a ratio k ($0<k\leq1$) dividing the output voltage changes between a relatively large ratio and a relatively small ratio according to the switching signal, and the discharge circuit stops discharge when the ratio changing according to the switching signal is relatively small.

13. The regulator according to claim 11, wherein the absolute value of the second voltage is lower than the absolute value of the first voltage.

14. The regulator according to claim 11, wherein the controller has an amplifier configured to reduce the absolute value of the difference between the reference voltage and the first voltage, and the absolute value of the second voltage is lower than a value that an input offset voltage of the amplifier is subtracted from the absolute value of the first voltage.

15. The regulator according to claim 11, wherein the discharge circuit has a comparator configured to compare the reference voltage with the first voltage, and the absolute value of the second voltage is lower than a value that an input offset of the comparator is subtracted from the absolute value of the first voltage.

16. The regulator according to claim 11, wherein the second voltage is a voltage that the first voltage is divided.

17. The regulator according to claim 11, wherein the discharge circuit has a discharge transistor configured to be turned off when the absolute value of the second voltage is lower than the absolute value of the reference voltage and to be turned on when the absolute value of the first voltage is higher than the absolute value of the reference voltage, the discharge transistor being connected between the output and the ground.

18. The regulator according to claim 17, wherein the discharge circuit further has a blocking transistor configured to be turned on or off according to the switching signal, the blocking transistor being connected between a control terminal of the discharge transistor and the ground.

19. The regulator according to claim 11, wherein the voltage detector has a first switch element configured to be turned on or off according to the switching signal.

20. The regulator according to claim 11, wherein the voltage detector has:

a first resistor and a second resistor connected in series between the output and the ground; and a third resistor connected in parallel with the first resistor or the second resistor through a first switch element configured to be turned on or off according to the switching signal.

* * * * *